US006265698B1

(12) United States Patent
Ching

(10) Patent No.: US 6,265,698 B1
(45) Date of Patent: Jul. 24, 2001

(54) OVERHEATING PROTECTOR FOR HEATERS

(75) Inventor: Chan Ching, Taipei Hsien (TW)

(73) Assignee: Perfect Union Co., Ltd., Taipei Hsien (TW)

( * ) Notice: Subject to any disclaimer, the term of this patent is extended or adjusted under 35 U.S.C. 154(b) by 0 days.

(21) Appl. No.: 09/552,007

(22) Filed: Apr. 19, 2000

(51) Int. Cl.[7] ..... H05B 3/02

(52) U.S. Cl. ..... 219/481

(58) Field of Search ..... 219/481, 530, 219/377, 347, 536, 542, 552, 436, 437, 441; 392/376, 360–370, 373

(56) References Cited

U.S. PATENT DOCUMENTS

| | | | | |
|---|---|---|---|---|
| 3,632,987 | * | 1/1972 | Orr | 219/530 |
| 3,767,898 | * | 10/1973 | Wells et al. | 219/441 |
| 4,395,619 | * | 7/1983 | Harigai | 219/377 |
| 5,381,509 | * | 1/1995 | Mills | 392/376 |
| 5,652,826 | * | 7/1997 | Mills | 392/376 |
| 6,127,659 | * | 10/2000 | Friedman et al. | 219/398 |

* cited by examiner

*Primary Examiner*—Tu Ba Hoang
(74) *Attorney, Agent, or Firm*—Dougherty & Troxell

(57) ABSTRACT

The present invention provides a electronic heater which uses a plurality of temperature sensing protector switches connected in series so that unusual temperature within said heater can be automatically detected if said heater is under abnormal use. The protector shut off the power of said heater in time to prevent overheating from happening and causing danger and to protect the safety of human beings or apparatuses.

4 Claims, 2 Drawing Sheets

OVERHEATING PROTECTOR FOR HEATERS

BACKGROUND OF THE INVENTION

1. Field of Invention

The present invention relates to an overheating protector for electronic heaters.

2. Related Art

It has been a common means to make use of electronic heat filaments or electronic heat tubes in electronic heaters to generate heat for all sorts of machining or getting warmth for a long time. Since these devices generate a lot of heat, they should have a good control of the high temperature due to the heat in order to prevent such events as human scalding, device burning, or serious fire from happening.

The heaters that have the closest relation to people are home baseboard heaters. Therefore, if the heaters are overheated, there would be direct injury to people in contact or cause safety problem to the space people are occupying. Although usually electronic heaters are provided therein overheating protectors, the ones in conventional electronic heaters are not ideal because conventional baseboard heaters have a larger wind outlet, which is quite different from a usual fan heater that has a smaller wind outlet and lower heat radiation. The area is so large that a thermostat can not effectively detect the temperature in each area of the heater. For example, if the thermostat is mounted in the center, then abnormal operations on both the left and right sides often can not be detected. Thus, the thermostat can not provide perfect protection and all baseboard heater manufacturers do not use them as the overheating protector but use the capillary liner limit control adopted in large air conditioners. This device is an overheating protector that has a thin capillary of about 2 meters long wrapping around the wind outlet of the heater. The thin capillary functions as the overheat detector on each part of the heater. When a local area is overheated, there would be an air pressure change to push a metal chip and timely shut off the power. Since the device utilizes a long and vacuum thin copper tube as a temperature detector that has to be nicely installed at the right position, so there come the following important problems which are not easy to resolve:

1. The installation of the thin copper tube is very troublesome and needs much care. Since the copper tube is thin and long, a deviation of the installation position often results in improper action. If the copper tube is carelessly broken and air leaks in, the whole protector completely loses its function.
2. Moreover, since the inside of the thin and long copper tube has to be vacuum, the manufacture of the protector becomes very difficult. It has to be calibrated to correct temperature settings before use. So usual capillary liner limit controls have a larger precision range (i.e. less precise). The difficulty in manufacture also makes the cost of the protector and thus that of the heater higher.
3. Furthermore, difficult manufacture of protectors also elongates delivery schedule and increases stocking cost. This problem results in frozen capital. Since the capillary is fragile, operational difficulty is another reason for a higher cost.

To solve the above problems, the inventor of the present invention, after long time of thought, experiments and corrections, finally came up with a method for disposing a plurality of thermostats in series at proper positions. This method once and for all solves such problems of installation, precision, fragility, expensive cost and long delivery schedule that are disadvantageous to the manufacture of capillary liner limit controls.

SUMMARY OF THE INVENTION

In view of the foregoing, it is then an object of the present invention to provide an overheating protector which can prevent all the above problems in the prior art.

The present invention provides an overheating protector for heaters, which uses two or more than two thermostats connected in series in a baseboard heater with a large area wind outlet to detect any unusual temperature rise therein and to provide power shutdown protection.

BRIEF DESCRIPTION OF THE DRAWINGS

The present invention will be described with reference to the accompanying drawings of which.

DETAILED DESCRIPTION OF THE INVENTION

Figure 1:
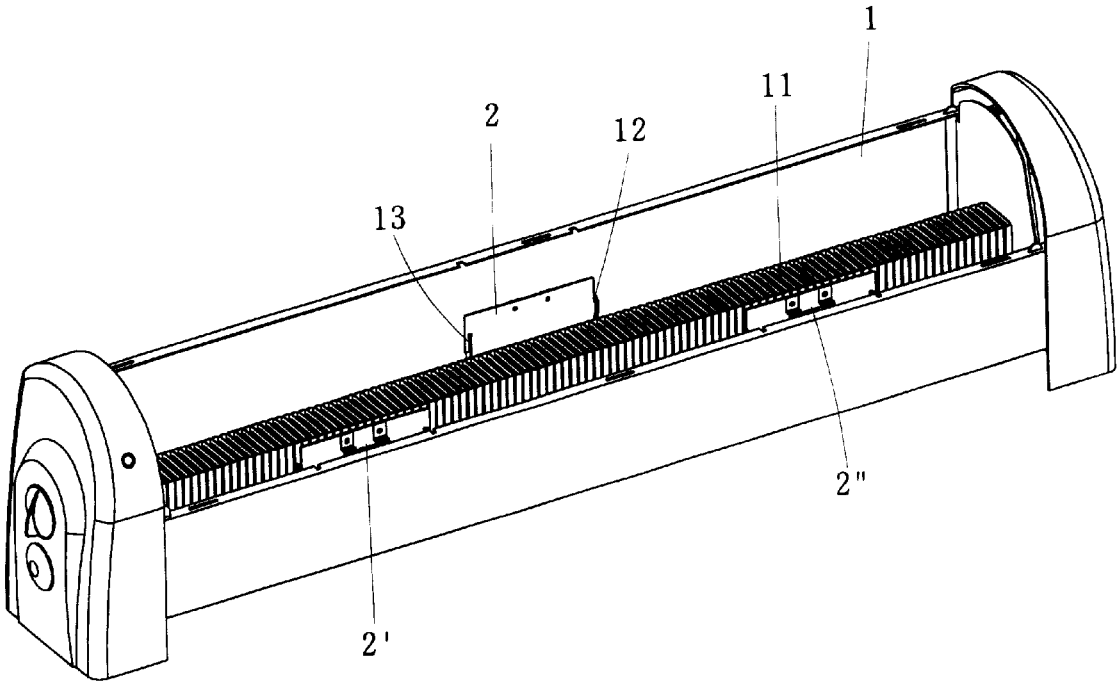
FIG. 1 is a three dimensional view of an embodiment heater according to the present invention.
Figure 2:
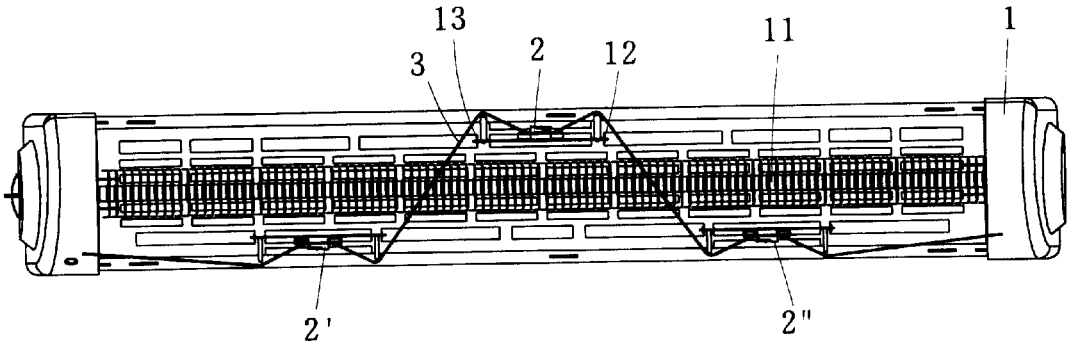
FIG. 2 is a top view of an embodiment heater according to the present invention.

As shown in FIGS. 1 and 2, the present invention relates to an electronic heater 1 which uses a plurality of thermostats 2 connected in series. The thermostats automatically detect whether the interior of the heater is over the normal temperature range and timely shut off the power to prevent overheating and to protect the safety of human beings and apparatuses.

Figure 3:
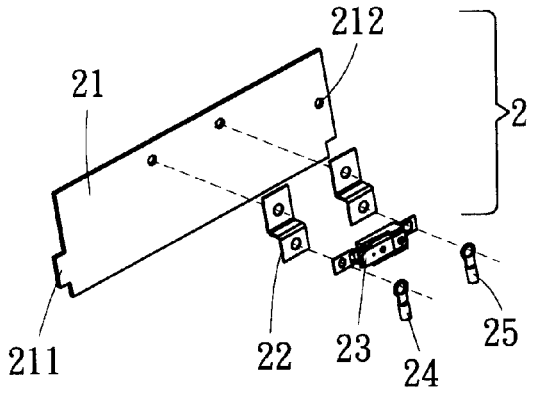
FIG. 3 is an three dimensional exploded view of a thermostat used in the present invention.
Figure 4:
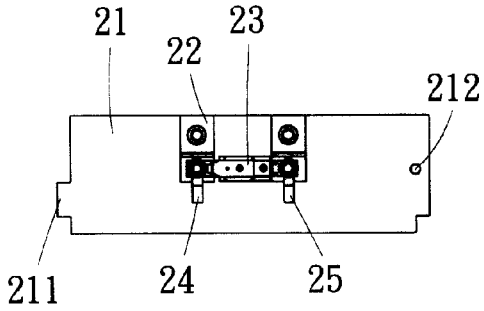
FIG. 4 is a front view f a thermostat used in the present invention.
Figure 5:
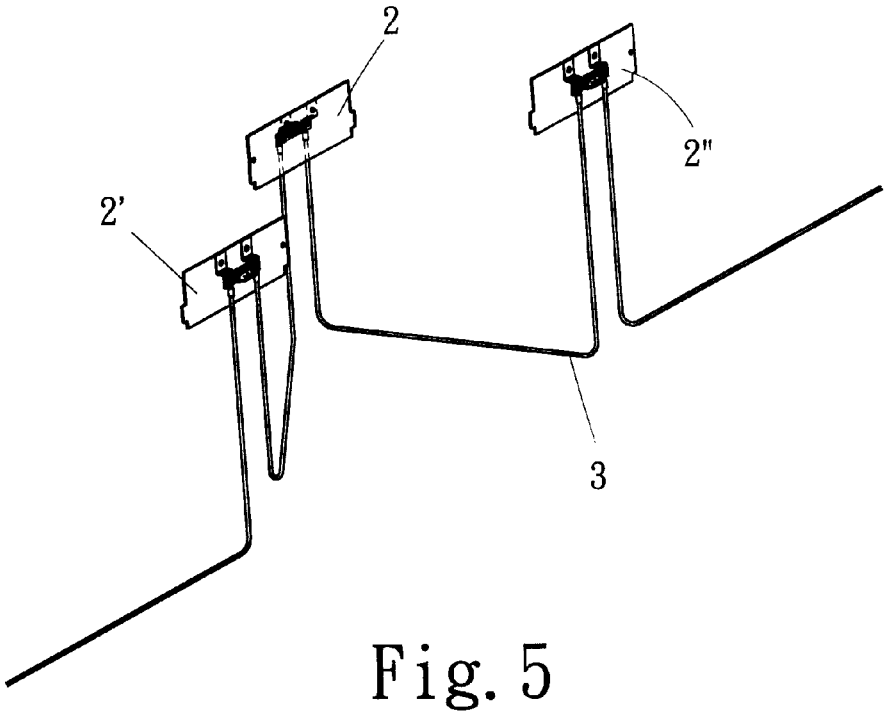
FIG. 5 is a three dimensional view of an embodiment of the present invention with a plurality of thermostat connected in series.

As shown in FIGS. 3 and 4, the thermostat 2 of the present invention comprises: a mica 21 for fixing a thermostat switch 23 via a switch support 22, said switch 23 being provided with an anode terminal 24 and a cathode terminal 25, said mica 21 having a pin 211 on one end and a hole 212 on the other so that said plurality of thermostats 2 can be connected in series through said anode terminals 24, said cathode terminals 25, and a wire 3 and form a protection network, as shown in FIG. 5.

As shown in FIGS. 1 and 2, said thermostats 2 connected in series can be disposed at tested proper positions outside a heating device 11 within said electronic heater 1. The fixing is achieved by providing by direct molding apertures 12 for said pins 211 on said micas 21 and elastic clips 13 for said holes 212 on said micas 21. This allows fast and efficient fixture of all thermostats 2, 2', 2" . . . connected in series within said electronic heater 1 so that they can effectively protect said electronic heater 1 from overheating. Thus, the present invention can replace the capillary liner limit controls used in the prior art.

Obviously, numerous modifications and variations of the present invention are possible in light of the above teachings. It is therefore to be understood that within the scope of the appended claims, the invention may be practiced otherwise than as specifically described herein.

What is claimed is:

1. An overheating protector for heater having a heating device located within an interior of an elongated housing, the housing having an elongated opening serving as a heat outlet, the protector comprising: at least two, non-capillary thermostat switches, each switch having an anode terminal and a cathode terminal, the thermostat switches being electrically connected in series; and mounting devices to mount each thermostat switch to the housing such that the at least two switches are located on the interior of the housing in which the heating device is located and are spaced apart along a length of the elongated housing.

2. The overheating protector of claim 1 wherein each mounting device comprises a plurality of mica members attached to the housing, each mica member having one of the at least two thermostat switches mounted thereon.

3. The overheating protector of claim 2 wherein mica member has a side edge with a protruding pin portion, each protruding pin portion engaging an aperture in the housing.

4. The overheating protector of claim 1 wherein the at least two thermostat switches are located on opposite sides of the heating device.

* * * * *